United States Patent [19]

Zerhoch et al.

[11] Patent Number: 4,543,739

[45] Date of Patent: Oct. 1, 1985

[54] STEAM IRONING STATION

[75] Inventors: Georg Zerhoch, Kaufering; Josef Sauter, Schrobenhausen; Richard Kiederle, Stadtbergen; Günther von Stein, Munich, all of Fed. Rep. of Germany

[73] Assignee: Veit GmbH & Co., Landsberg, Fed. Rep. of Germany

[21] Appl. No.: 491,907

[22] Filed: May 5, 1983

[30] Foreign Application Priority Data

May 12, 1982 [DE] Fed. Rep. of Germany ..... 3217872

[51] Int. Cl.[4] ..... D06F 81/08

[52] U.S. Cl. ..... 38/15; 38/103; 248/676

[58] Field of Search ..... 38/14, 15, 16, 107, 38/112, 142, 103, 104; 248/676, 647, 117.1, 117.2; 312/250, 253

[56] References Cited

U.S. PATENT DOCUMENTS 2,200,132 5/1939 Di Mauro .
2,542,244 2/1951 Gerhardt et al. ..... 248/647 X
2,602,615 7/1952 Maynard et al. ..... 248/647
4,372,065 2/1983 Hildebrand .

FOREIGN PATENT DOCUMENTS 1953615 1/1967 Fed. Rep. of Germany .
1974029 11/1970 Fed. Rep. of Germany .
2456881 8/1976 Fed. Rep. of Germany .
2750817 7/1978 Fed. Rep. of Germany .
2938443 4/1981 Fed. Rep. of Germany .
1102750 10/1955 France ..... 248/647

*Primary Examiner*—Werner H. Schroeder
*Assistant Examiner*—Andrew M. Falik
*Attorney, Agent, or Firm*—Kenyon & Kenyon

[57] ABSTRACT

A steam ironing station for ironing differently shaped apparel work pieces is designed to be fitted with various ironing table forms. A blower, air guiding chamber, and exhaust chimney are included in a compact housing assembly with a mounting plate on its top for receiving and holding differently shaped ironing work tables. The housing assembly is held in lateral struts of a frame-like base provided with a pedestal.

16 Claims, 5 Drawing Figures

STEAM IRONING STATION

BACKGROUND OF THE INVENTION

The invention relates to steam ironing stations in general and more particularly to a station adaptable to different work programs.

German Petty Patent DE-GM No. 19 74 029 as well as German Pat. No. 27 50 817 disclose steam ironing stations which include an ironing work table, air permeable at its surface, arranged above a housing stand. The housing stand contains a blower including an associated switching device, the air permeable surface of the work table being in communication with the suction or blowing opening of the blower via an air guiding chamber. This chamber has at least one further air connection for optionally blowing air to or suctioning air from an ironing form which is arranged on a swinging arm and is likewise air permeable at its surface. Steam ironing stations find frequent application in plants and devices for the manufacture and processing of apparel made from textiles and of other articles. During manufacture in the apparel industry, such steam ironing stations are used in the intermediate as well as in the final ironing department, where they must be adaptable to different operating conditions. The built-in blower has as one purpose the suctioning off, in the ironing support, moisture which inevitably accumulates during steam ironing. Another purpose of the blower is the drying of textile material which has been subjected to an ironing operation and is therefore moist. The two purposes may be alternately implemented optionally by switching from a suction mode to a blowing mode.

Because of the great variation in applications, a single table-like ironing surface is, as a rule, not sufficient for such steam ironing stations. The ironing stations must also allow ironing on or at special ironing form cushions for special ironing work. This purpose is served by the above mentioned swinging arm, to the free end of which each of several ironing forms can be selectably attached.

However, independently of the swinging arm with an ironing form attachment, an interchange between different ironing work tables or ironing work support is also necessary if universal employment of such a steam ironing station is desired. These tables or supports must also be attachable with different alignments relative to the stand housing.

It is further expected of such a steam ironing station that it can be fitted to the operator to optimize working conditions. In this connection, the height of the ironing work surface and, optionally, a certain inclination of the ironing work surface to the horizontal are important.

It is an object of the present invention to provide for a steam ironing station of the above-described type a simple mechanical design which can be adapted readily for different types of ironing work to be performed by means of different accessory elements, or which can be reset quickly for a new work program.

SUMMARY OF THE INVENTION

An improved steam ironing station of the kind described above is designed, according to the present invention, by having the blower, together with the air guiding chamber, including an exhaust air chimney for suction operation, as an independent housing assembly. The air guiding chamber mounting plate on the top side for receiving and fastening the ironing work table including its connecting tube and further has at least one lateral connecting tube stub or a swinging arm. By holding the housing assembly in lateral struts of a frame-like base provided with a pedestal the steam ironing station can be made adjustable in height.

A housing assembly consisting of a blower at the bottom with an air guiding chamber arranged above including the necessary exhaust air chimney is designed, in accordance with the present invention, in an extremely compact way. The housing assembly can be arranged without additional stiffening elements as a support body for ironing work tables and swinging arms including an iron suspension, in a basic mounting frame of simple design, adjustable in height in lateral struts.

DETAILED DESCRIPTION

Figure 1:
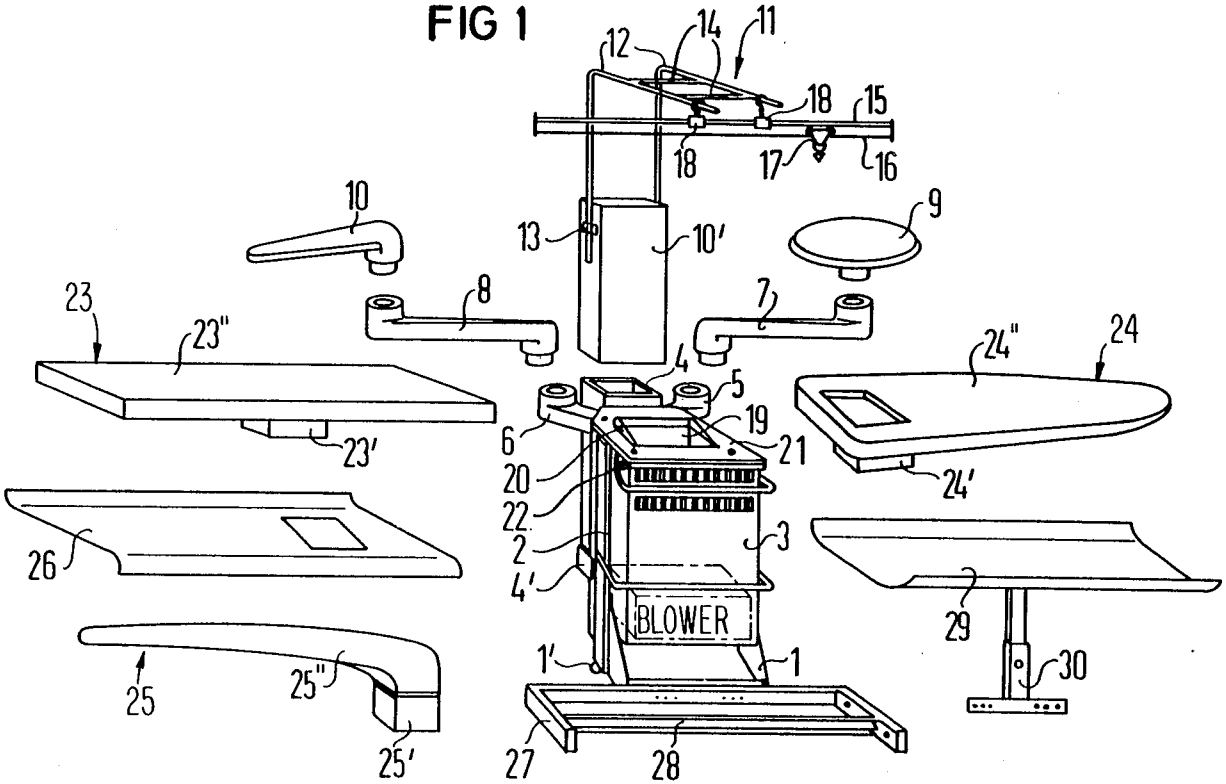
FIG. 1 shows a multi-configuration steam ironing station according to the present invention, in an exploded view.

The basic equipment of a steam ironing station in accordance with the present invention is shown in the center of FIG. 1. The equipment includes a base frame 1 with lateral struts 2 in which a housing assembly 3 is arranged adjustably in height in sliding blocks (not shown) aided by a gas pressure spring. The housing assembly 3 has, on its back side, an exhaust air chimney 4 as well as, laterally thereto, connecting tube stubs 5 and 6 arranged at an upper end of the housing assembly for receiving respective swinging arms 7 and 8. Ironing forms 9 and 10 mountable on the free ends of swinging arms 7 and 8. The exhaust air chimney 4 further has an attachment or extension 10' and to which an iron suspension device 11 can be fastened.

The iron suspension device 11 consists, in the manner of gallows, of two mutually parallel tubes 12 fastened detachably in holders 13. At their free ends, bent off at right angles, the tubes 12 are detachably connected to each other by cross tubes 14 having the same tube cross section. A support tube 15 with tracks 16 fastened parallel thereto and with a movable suspension member 17 is fastened to the tubes 12 via mounting elements 18. The mounting elements themselves each consist of two tube holders disposed above and are turned 90° relative to each other. Advantageously, the tube holders are designed as clamping sleeves so that the mounting elements 18 can be secured at to the support tube 15 as well as to the tubes 12 at any desired point.

The housing assembly 3 has, on the top side, an opening 19 provided with a collar-like extension 20 which rises obliquely toward the back. With this extension 20, the opening 19, which represents the blowing/suction connection for an ironing work table, communicates with a suitably designed opening of a mounting plate 21 which covers the housing assembly 3 from the top. The mounting plate 21 is rotatably supported in a hinge 22 on the front side of the housing assembly 3 and can be locked, together with an ironing table fastened thereto, at predetermined small positioning angles to the horizontal base position and can also be swung up into a vertical position. In the swung-up position of the mounting plate, access to the blower through the air guiding chamber is provided, which allows easy cleaning of the blower wheel.

The exhaust air chimney merges, at its lower end, into a drawer 4' which contains, in a manner permitting ease of service, the electrical circuitry required for the operation of the blower as well as for control and supervision.

As is shown in FIG. 1, the following can be fastened to the mounting plate 21: a rectangular ironing work table 23, centered; an ironing board-like work table 24 extending to the right; or, also, an ironing blade 25 with underlying deposition board 26 projecting to the left. The ironing work tables 23 and 24 as well as the ironing blade 25 each have an air connecting stub, 23', 24' or 25', for connection to the blower via the opening 19, extending over the collar-like attachment 20. Ironing work tables 23 and 24 and ironing blade 25 have respective air permeable surfaces 23", 24" and 25".

The base frame 1, the dimensions of which fit the housing assembly 3, requires the additional pedestal 27 which consists of an open rectangular frame with a foot switching bar 28, arranged therein between the short side legs for secure footing. The foot switching bar 28 can be adjusted as required, in depth, perpendicular to the short legs of the frame base. In FIG. 1 the pedestal 27 is detachably fastened with its long frame part at the front side to the base frame of the mounting base 1. However, it can also be fastened, if required, with one of its two short side legs on the front side as well as on the left or right side of the base front. So that the steam ironing station or the basic equipment can easily be moved around, the base frame 1 has base rollers 1' on both sides, at least on the back side.

FIG. 1 also shows, on the right-hand side, a collecting tray 29 which can be fastened with its height-adjustable base 30 to the pedestal 27 and which is used in conjunction with the ironing work table 24.

Figure 4:
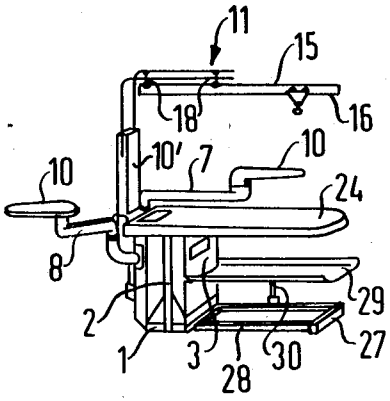
FIG. 4 is a perspective view of a third embodiment of a specific configuration of a steam ironing station according to FIG. 1.
Figure 3:
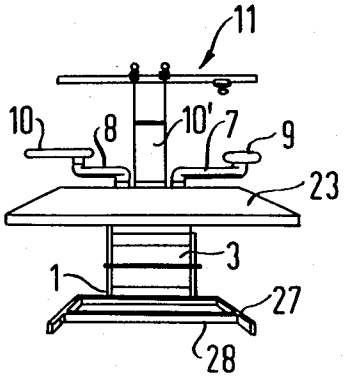
FIG. 3 is a perspective view of a second embodiment of a specific configuration of a steam ironing station according to FIG. 1.
Figure 2:
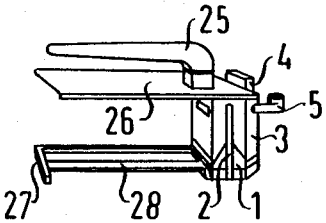
FIG. 2 is a perspective view of a first embodiment of a specific configuration of a steam ironing station according to FIG. 1.

Three of many other possible different design variants or configurations are shown, as examples only, in FIGS. 2, 3 and 4.

FIG. 2 shows a typical steam ironing station configuration for the ironing of trousers. It makes use of the deposition board 26 with an arm 25 arranged thereabove. The pedestal 27 has its short right hand side leg fastened to the front side of the base frame 1. The attachment 10 and the exhaust air chimney 4 can be omitted here because, in such an ironing arrangement, an iron suspension device would be more a hindrance than an advantage.

The configuration of FIG. 3 shows a design variant such as is already indicated in FIG. 1. It uses the ironing work table 23 which is fastened centered to the mounting plate 21 and extends forward.

The configuration of FIG. 4 makes use of the ironing work table 24 with the collecting tray 29 arranged underneath, the base 30 of tray 29 being fastened to the pedestal 27. The pedestal 27 is in turn fastened to the base frame at the left short leg of the pedestal. So as to make use of the iron suspension device 11 in this orientation of the ironing work table 24, the support tube 15 with the track 16 fastened thereto must be arranged parallel to the angled-off tube sections of the tubes 12. In this case, the mounting elements 18 connect to the cross tubes 14 of suspension device 11 and to support tube 15.

In other configurations of the steam ironing assembly of FIG. 1, blade 25, or ironing work table 24, with the deposition board thereunder extends to the side of the basic equipment instead of forward. In this case the pedestal 27 must have one of its short side legs fastened laterally to the base frame.

Figure 5:
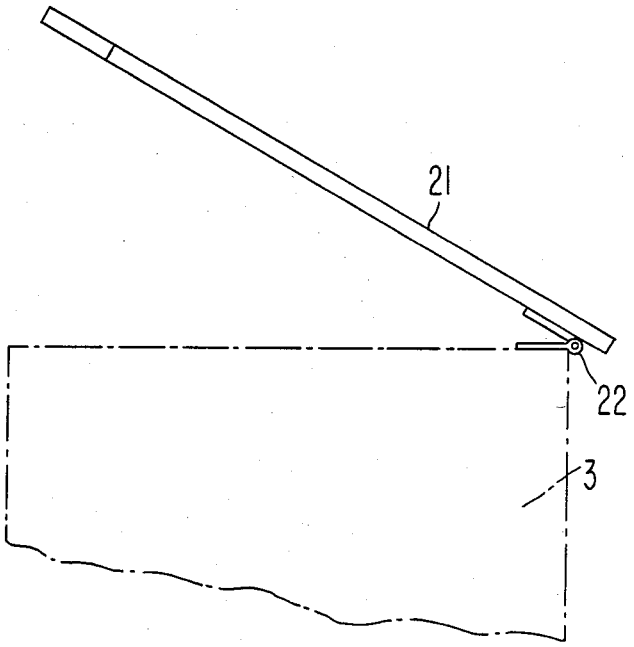
FIG. 5 is a partial side view of a mounting plate and hinge structure included in the steam ironing station of FIG. 1.

FIG. 5 shows in detail the structure of hinge 22 by means of which mounting plate 21 is rotatably fastened to housing assembly 3 for rotation about a horizontal axis extending parallel to and proximate to the edge between the top side and front side of the housing assembly.

What is claimed is:

1. In a steam ironing station including: an ironing work table which has an air permeable surface and is arranged above a housing stand, said housing stand having an air guiding chamber; a blower disposed in the housing stand, said blower having a suction or blowing opening communicating with said air guiding chamber, said air permeable surface being in controllable communication with the suction or blowing opening of the blower via said air guiding chamber; and at least one further air connection for optionally supplying an ironing form which is arranged on a swinging arm and likewise has an air permeable surface in controllable communication with the suction or blowing opening of the blower, the improvement comprising the blower together with the air guiding chamber forming an independent housing assembly having a top side and at least one substantially vertical side, said housing assembly including an exhaust air chimney extending upwardly on said vertical side, said housing assembly being provided with a mounting plate on the top side for receiving and holding the ironing work table and with at least one lateral connecting tube stub and an associated swinging arm, the steam ironing station further including a frame-like base with lateral struts and a pedestal, said housing assembly being supported in said struts.

2. A steam ironing station according to claim 1, wherein said frame-like base is matched to the dimensions of the bottom of the housing assembly and said pedestal is elongate and has at least one long side and a pair of opposed short sides.

3. A steam ironing station according to claim 2 wherein said elongate pedestal is a rectangular steel frame open at its forward broad side, said steel frame containing, between frame legs forming narrow sides, a foot switching bar.

4. A steam ironing station according to claim 3 wherein the mounting plate on the top side of the housing assembly is rotatably supported in a hinge parallel to a side at the front of the housing assembly.

5. A steam ironing station according to one of the claims 1, 2 and 5 wherein said housing assembly has a back side and a front side generally opposite thereof and wherein the exhaust air chimney extends upward on the back side of the housing assembly, said back side constituting said vertical side, attachment means for fastening a lower part of an iron suspension device to the housing assembly being provided on the housing assembly, the exhaust air chimney merging, on its underside, with a drawer for accommodating electrical components and circuits for a power line and control of the blower.

6. A steam ironing station according to claim 5, wherein the iron suspension device comprises a parallel overhanging arrangement of the two tubes, said attachment means including holders for detachably securing said two tubes at the lower part of the suspension device to said housing assembly on opposite sides of the exhaust air chimney, the width of the exhaust air chimney determining the spacing between the tubes.

7. A steam ironing station according to claim 5, wherein said frame-like base has a bottom end and is provided with rollers on its bottom end at least in the region of the back side.

8. A steam ironing station according to one of the claims 1, 2 or 3 wherein the frame-like base has a bottom end, a back side and a front side and is provided with rollers on the bottom end at least in the region of the back side.

9. In a steam ironing station including: an ironing work table which has an air permeable surface and is arranged above a housing stand, said housing stand having an air guiding chamber; a blower disposed in the housing stand, said blower having a suction or blowing opening communicating with said air guiding chamber, said air permeable surface being in controllable communication with the suction or blowing opening of the blower via said air guiding chamber; and at least one further air connection for optionally supplying an ironing form which is arranged on a swinging arm and likewise has an air permeable surface in controllable communication with the suction or blowing opening of the blower, the improvement comprising: the blower together with the air guiding chamber forming an independent housing assembly having a top side and being provided on said top side with a mounting plate for receiving and holding the ironing work table, said mounting plate being swingably secured to said housing assembly for rotation about a horizontal axis.

10. A steam ironing station according to claim 9, wherein said housing assembly is further provided with at least one lateral connecting tube stub and an associated swinging arm pivotably mounted to said connecting tube stub for rotation about a vertical axis.

11. A steam ironing station according to claim 9, wherein said housing assembly has a vertical side and includes an exhaust air chimney extending upwardly on said vertical side.

12. A steam ironing station according to claim 9 wherein the steam ironing station further includes a frame-like base having lateral struts and a pedestal, said housing assembly being supported in said struts.

13. In a steam ironing station including: an ironing work table which has an air permeable surface and is arranged above a housing stand, said housing stand having an air guiding chamber; a blower disposed in the housing stand, said blower having a suction or blowing opening communicating with said air guiding chamber, said air permeable surface being in controllable communication with the suction or blowing opening of the blower via said air guiding chamber; and at least one further air connection for optionally supplying an ironing form which is arranged on a swinging arm and likewise has an air permeable surface in controllable communication with the suction or blowing opening of the blower, the improvement comprising: the blower together with the air guiding chamber forming an independent housing assembly, the steam ironing station further including an iron suspension device for hangingly supporting an ironing means above the work table and attachment means on the housing assembly for fastening a lower part of the iron suspension device to the housing assembly.

14. A steam ironing station according to claim 13, wherein the iron suspension device comprises a parallel overhanging arrangement of two tubes, said attachment means including holders for detachably securing said two tubes at the lower part of the suspension device to said housing assembly.

15. A steam ironing station according to claim 14, wherein said housing assembly has a vertical side and an exhaust air chimney extending upwardly on said vertical side, a first one of said holders and a second one of said holders being disposed on opposite sides of said exhaust air chimney, the width of the exhaust air chimney thereby determining the spacing between said tubes.

16. In a steam ironing station including: an ironing work table which has an air permeable surface and is arranged above a housing stand, said housing stand having an air guiding chamber; a blower disposed in the housing stand, said blower having a suction or blowing opening communicating with said air guiding chamber, said air permeable surface being in controllable communication with the suction or blowing opening of the blower via said air guiding chamber; and at least one further air connection for optionally supplying an ironing form which is arranged on a swinging arm and likewise has an air permeable surface in controllable communication with the suction or blowing opening of the blower, the improvement comprising: the blower together with the air guiding chamber forming an independent housing assembly having a vertical side and an exhaust air chimney extending upwardly on said vertical side, said exhaust air chimney having an underside, said steam ironing station further including a drawer for accommodating electrical components and circuits for a power line and control of the blower, said exhaust air chimney merging on said underside with said drawer.

* * * * *